US006164291A

United States Patent [19]

Filippone

[11] Patent Number: 6,164,291

[45] Date of Patent: Dec. 26, 2000

[54] RETRACTING HAIRHOLDER DEVICE

[76] Inventor: Thomas C. Filippone, 595-6 Auten Rd., Hillsborough, N.J. 08876

[21] Appl. No.: 09/517,407

[22] Filed: Mar. 2, 2000

[51] Int. Cl.[7] ..... A45D 8/36

[52] U.S. Cl. ..... 132/273; 24/18

[58] Field of Search ..... 132/273, 275; 24/18, 269, 17 B

[56] References Cited

U.S. PATENT DOCUMENTS

| | | | |
|---|---|---|---|
| 706,034 | 8/1902 | Dean et al. | 24/18 |
| 1,124,130 | 1/1915 | Grant | 24/18 |
| 1,141,245 | 6/1915 | Gillespie . | |
| 1,165,816 | 12/1915 | Tichenor . | |
| 1,241,130 | 9/1917 | Leigh . | |
| 1,241,337 | 9/1917 | Breitenstein . | |
| 1,258,507 | 3/1918 | Walton | 24/18 |
| 3,000,384 | 9/1961 | Piers, Jr. | 132/46 |
| 3,084,699 | 4/1963 | Gedid | 132/46 |
| 3,276,083 | 10/1966 | Gubash | 24/18 |
| 3,413,986 | 12/1968 | Triangolo | 132/46 |
| 3,430,303 | 3/1969 | Perrin et al. | 24/117 |
| 5,535,765 | 7/1996 | Takashima | 132/273 |
| 5,655,272 | 8/1997 | Young | 24/17 B |
| 5,709,013 | 1/1998 | Stanback | 132/273 |
| 5,722,266 | 3/1998 | Yeager et al. | 70/57 |
| 5,778,904 | 7/1998 | Elsner | 132/275 |
| 5,901,713 | 5/1999 | Mroczek | 132/275 |

*Primary Examiner*—Todd E Manahan
*Attorney, Agent, or Firm*—Kenneth P. Glynn, Esq.

[57] ABSTRACT

A retracting hairholder device includes a main body casing for retaining a tensioned coilable flexible non-elastic cord member. The flexible non-elastic cord member extends from the main body casing to form a loop and has a wound position and a plurality of measurable unwound positions. The flexible non-elastic cord member is coupled with a tension member contained within the main body casing which imparts sufficient tension upon the flexible non-elastic cord member such that it is pre-disposed toward a wound position so as to securely bind a lock of hair once placed within the loop. The flexible non-elastic cord member may be manually loosened or unwound in order to permit removal of the lock of hair. In one embodiment, the flexible non-elastic cord member may be locked into any position by a locking member. In another embodiment, a torquing member may be employed to confer added binding capabilities.

20 Claims, 4 Drawing Sheets

RETRACTING HAIRHOLDER DEVICE

BACKGROUND OF THE INVENTION

1. Field of the Invention

The present invention is directed to hairholder devices and, more particularly, to hairholder devices which include a main body casing and a non-elastic cord member which is tensioned so as to permit a lock of hair to be secured thereby for enabling a pony tail or the like.

2. Information Disclosure Statement

Conventional hairholder devices are presently available in a variety of configurations which bind hair to engender a pony tail or the like. However, no prior art device teaches a retractable non-elastic flexible cord member which is retained by a main body casing so as to deliver improved binding profiles as well as maintain the integrity of the hair itself. The following patents describe the present state of the art with reference to hairholding devices.

U.S. Pat. No. 1,241,130 to J. F. Leigh describes a copy-holder, which is the combination of a plate, a shelf hinged to the lower edge thereof and capable of two positions in one of which it extends forwardly substantially at a right angle to the plate and in the other of which it is substantially in the same plane with the plate, an arm extending rearwardly from the under side of the shelf, an upwardly extending pawl pivoted to said arm and located on the back of the plate, said plate being formed with a lug against which said pawl engages to hold the shelf in its right-angular position, a casing is secured to the back of the plate and inclosing the upper end of the pawl, and a spring is secured to the casing and bearing against the pawl to force the pawl into locking engagement with the lug, said pawl being formed with a finger-piece that extends below the pivot.

U.S. Pat. No. 1,241,337 to J. G. Breitenstein describes the combination of a grip device which comprises a cupped member, a flat member and connecting means by which they are secured together, with the flange of the cupped member engaging the surface of the flat member, but yieldingly separable therefrom, and a flexible tie formed in a loop outside of the grip device, with its two end portions entering said device through separate apertures therein and adapted to emerge in opposite directions respectively, between the edge of the cupped member and the face of the flat member, to be gripped thereby.

U.S. Pat. No. 1,141,245 to C. W. Gillespie describes a cup-shaped case member having a centrally located spring arbor, a reel member journaled on the arbor and having a peripheral cord channel and a central spring chamber, the wall of said reel member extending from the peripheral cord channel to the arbor being arranged parallel with and in proximity to the inner face of the cup-shaped case member whereby a spring chamber of maximum transverse dimensions is provided, a cord secured at one end in the cord channel of the reel member and extending peripherally through the case member, a convolute spring secured at one end to the central arbor and at the opposite end to the reel member, a cover plate closing the open side of the case member and open side of the reel member, said cover plate being centrally supported by the spring arbor against inward deflection, and a clamping nut which comprises a disk-like member having a convex inner face secured directly on the end of the arbor outside of the cover plate and forming with said cover plate an inwardly converging clamp in which the free end of the cord may be clamped and held.

U.S. Pat. No. 1,165,816 to E. J. Tichenor describes a cord holder, a casing, a spring controlled cord retaining spool which is rotatably mounted within said casing, a pin which is detachably carried by said casing, an enlarged head which is formed upon said pin, a spiral spring that is coiled about said head and that has its outer end extending above the outer end of said head for receiving between the outer convolutions thereof the end of said cord for holding it against the tension of the spring carried by said spool.

U.S. Pat. No. 3,000,384 to E. F. Piers, Jr. describes a fastener which comprises an elongated flexible tape which has on opposite faces thereof interengageable mating surfaces which include a first surface provided with a multiplicity of small outwardly projecting loops made of stiff filamentary material and a second surface having a multiplicity of curly filamentary members releasably interengageable with said loops, operative portions of said surfaces being displaced from one another longitudinally of the tape.

U.S. Pat. No. 3,084,699 to J. C. Gedid describes a brush roller assembly which comprises a brush roller and a separate jacket therefore, said jacket being adapted for interposition between said roller and the scalp of a wearer thereof, and consisting of a thin, resilient, stretchable flexible sheet having adjacent one end thereof a transversely extending, hair-receiving slit closed at both ends, said slit being unobstructed and adapted to permit the passage of a lock of hair directly therethrough without substantial crimping, said sheet having adjacent the other end thereof means for securing said other end to said roller whereby said jacket may be stretched under tension circumferentially around at least a substantial portion of said roller over a lock of hair rolled thereon to provide the sole means for holding said lock of hair and said roller in place.

U.S. Pat. No. 3,413,986 to D. A. Triangolo describes a hair ornament that is adapted to be placed on the head of a wearer and that is formed of a spring wire material, a plurality of ornamental articles being cast around the spring wire such that arcuate-shaped bores are formed therein, the spring wire having an arcuate conformation and being received in snug fitting relation within the arcuate ornaments such that rotation of the ornaments on the wire is prevented.

U.S. Pat. No. 3,430,303 to D. E. Perrin et al. describes a shoe lace coiler for piggy-back mounting upon a shoe which is disclosed for coiling and releasably holding the lace tightly drawn upon the shoe. The coiler comprises a coiling motor in the form of a spindle having a length several times its diameter and having a slot for receiving the lace ends in gripping relation, a housing journaling the rotor therein to define an annular lace storage chamber, the housing having a window for lace travel, and a winding control engageable with the rotor and the housing for turning the rotor in a lace take-up direction, the control including a rachet wheel rotatable with the rotor and selectively engageable with rachet teeth on the housing for holding the rotor against reverse rotation.

U.S. Pat. No. 5,535,765 to Y. Takashima describes a hair binder which is for binding a bunch of long hair which includes an elastic hairband, a pair of frames joined at proximal ends thereof for opening and closing relative to each other, the frames forming a circle when closed, a first engaging structure disposed at distal ends of the pair of frames for engaging opposite ends of the band, and a second engaging structure disposed at the proximal ends for engaging intermediate positions of the band when the frames are opened, and releasing the intermediate positions when the frames are closed.

U.S. Pat. No. 5,722,266 to L. R. Yeager et al. describes a security device which includes a locking member, a rachet member, and a plurality of cables. The cables extend through both a fastener and a base of the locking member and are wrapped around all six sides of a book or box-like structure. The fastener is releasably snap-fitted into the base and secured therein by a pair of metal tines. The rachet member includes a housing containing a gear and bearing member which are latched together in a spaced relationship to form a reel and a pawl. A bottom plate encloses the contents of the housing. The gear includes a multi-sided key hole, a plurality of openings to secure enlarged ends of the cables therein, and a plurality of teeth. The gear and bearing member each include an annular nub which sits in and rotates around a corresponding bearing surface of the bottom plate and housing, respectively. The pawl has a catch and a resilient spring and communicates with the gear to allow the rachet member to be turned only in one direction. Two specialized tools are required to tighten the device around the box-like structure and to remove the security device from the same.

U.S. Pat. No. 5,778,904 to S. C. Elsner describes a tie fastener which has an elastomeric cord formed into a loop by passing the terminal ends of the cord through a compression spring actuated cord lock. A stop bead positioned on the loop prevents the loop end of the elastomeric cord from inadvertently being removed from the cord lock. Pendant beads affixed to the terminal ends of the cord prevent the cord from inadvertently being pulled out of the cord lock.

Notwithstanding the prior art, the present invention is neither taught nor rendered obvious thereby.

SUMMARY OF THE INVENTION

A retracting hairholder device includes a main body casing for retaining a tensioned coilable flexible non-elastic cord member. The flexible non-elastic cord member extends from the main body casing in the form of a loop and has a wound position and a plurality of measurable unwound positions. The flexible non-elastic cord member is coupled with a tension member contained within the main body casing which imparts sufficient tension upon the flexible non-elastic cord member such that it is pre-disposed toward a wound position so as to securely bind a lock of hair once placed within the loop. In the preferred embodiment of the present invention, the graspable portion the cord member is situated flush with an outer surface area of the main body casing when it is in its wound position. A user may then grasp the cord member and pull upon cord to enlarge the size of the loop in order to insert a lock of hair and thereafter release the cord member which retracts with sufficient force to bind the lock of hair within the loop and against the main body casing. The flexible non-elastic cord member may thereafter be manually loosened or unwound in order to permit removal of the lock of hair. In one embodiment, the flexible non-elastic cord member may be locked into any position by a locking member. In another embodiment, a torquing member may be employed to confer added binding capabilities. In yet another embodiment, a recessed segment may be defined upon the main body casing in order to promote the ease by which a user may grasp the cord member when in its wound position.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

A retracting hairholder device includes a main body casing for retaining a tensioned coilable flexible non-elastic cord member. The flexible non-elastic cord member extends from the main body casing in the form of a loop and has a wound position and a plurality of measurable unwound positions. The flexible non-elastic cord member may, of course, be any size, may comprise any suitable length and may be composed of any suitable article of manufacture known to be used in the art without exceeding the scope of the present invention. The flexible non-elastic cord member is coupled with an internally established tension member contained within the main body casing which imparts sufficient tension upon the flexible non-elastic cord member such that it is pre-disposed toward a wound position so as to securely bind a lock of hair once placed within the loop. The tension member is preferably defined by a rotating carrier mechanism which is capable of journaling and winding the flexible non-elastic cord member thereupon and thus, retracting the cord member into the main body casing such that the tension member is rotating while the cord member is retracted within the main body casing.

In the preferred embodiment of the present invention, the graspable portion the cord member is situated flush with an outer surface area of the main body casing when it is in its wound position. A user may then grasp the cord member and pull upon the cord member to enlarge the size of the loop in order to insert a lock of hair and thereafter release the cord member which then retracts with sufficient force to bind the lock of hair within the loop and against the main body casing. The flexible non-elastic cord member may thereafter be manually loosened or unwound in order to permit removal of the lock of hair. The main body casing is preferably round in shape, but may comprise any variety of shapes or sizes without exceeding the scope of the present invention. In fact, it is to be understood that the main body casing may be fashioned to possess the form of an animal or vehicle or otherwise. In an alternative embodiment, the flexible non-elastic cord member may be locked into any position by a locking member, which clutches the cord member or lodges the cord member in place to prevent loosening or tightening of the same. In yet another embodiment, a torquing member may be employed to confer added binding capabilities to the cord member and to thereby effect a more versatile and rigorous binding profile. In yet another embodiment, a recessed segment may be defined upon the main body casing in order to promote the ease by which a user may grasp the cord member when in its wound position. Furthermore, should be understood to be within the scope of the present invention to, as an alternative, employ an elastic or semi-elastic cord member so as to engender additional torquing capabilities.

Figure 1:
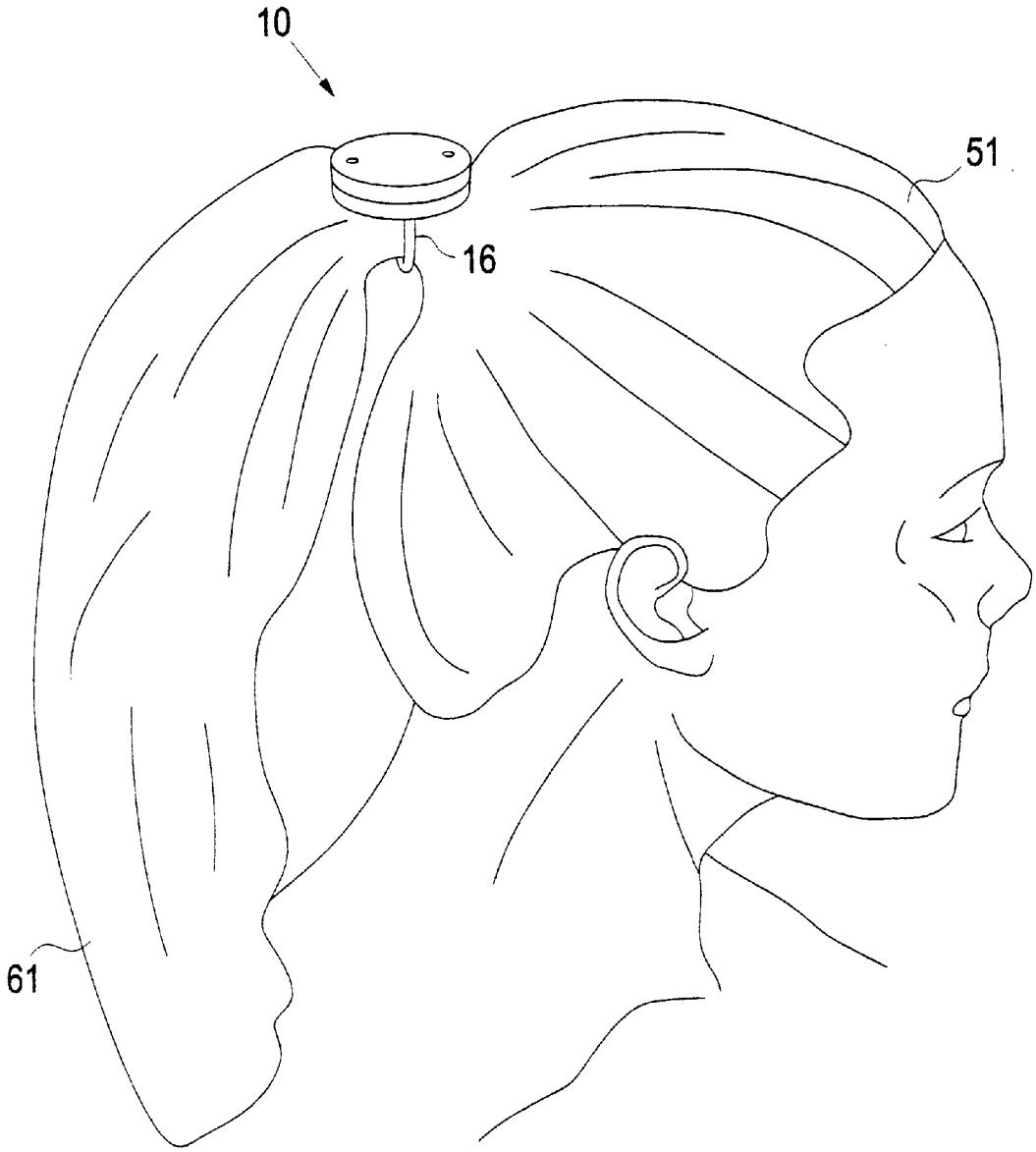
FIG. 1 shows a perspective view of a female head, generally illustrated, and shows a present invention retracting hairholder device in use thereupon so as to bind a lock of hair and engender a pony tail.
Figure 2:
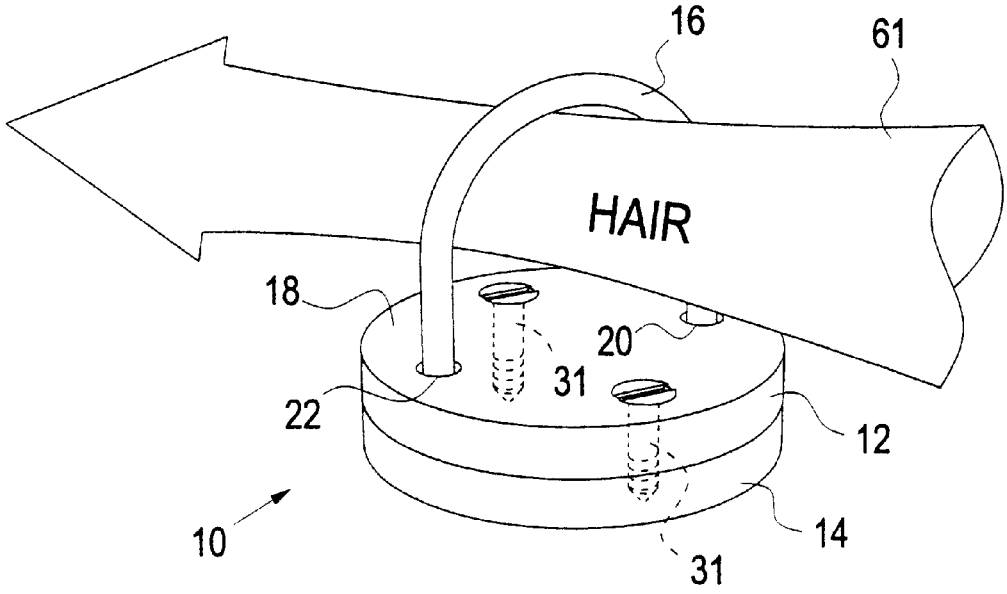
FIG. 2 shows a perspective view of the retracting hairholder device disclosed in FIG. 1.
Figure 3:
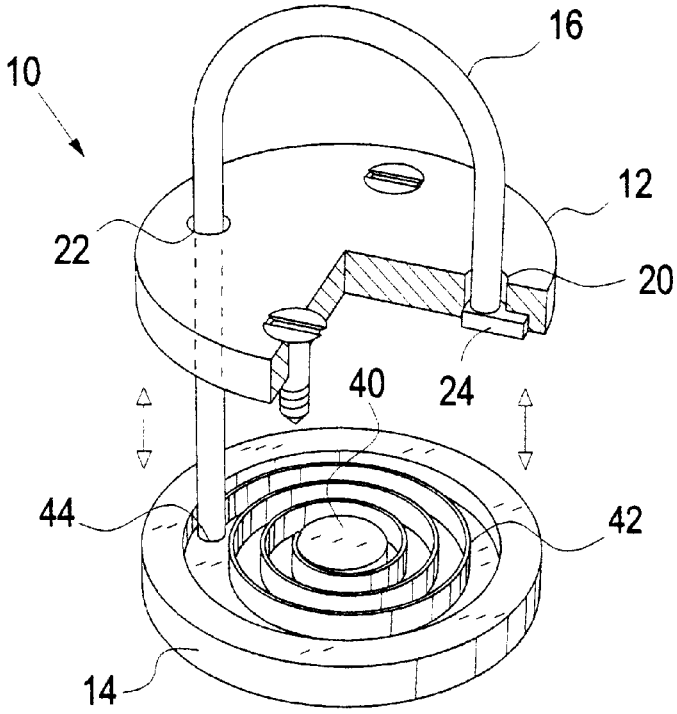
FIG. 3 shows a partial cut perspective view of the retracting hairholder device disclosed in FIGS. 1 and 2, illustrating details of the internal tension members and retracting cord member.

It is apparent that existing art does not provide for a non-elastic retracting cord member or, in the alternative, an elastic retracting cord member which is integral with a main body casing to produce a retracting hairholder device as taught herein. Conventional art which employs any sort of flexible binding member(s) is limited to using elastic members which have a proclivity to damage hair and a tendency to tangle hair while in use as well as during application and removal due to the common tendency to twist and intertwine with hair. Accordingly, it is a principal object of the present invention to disclose an improved binding profile for protecting the integrity of hair while at the same time offering a more versatile binding capacity. The present invention will be more thoroughly understood with reference to the Figures disclosed herein FIG. 1 shows a perspective view of a female head, generally illustrated for purposes of demonstrating one possible manner of use for the present invention, thus, showing a present invention retracting hairholder device in use binding a lock of hair and engendering a pony tail. FIG. 2 shows a perspective view of the retracting hairholder device disclosed in FIG. 1. FIG. 3 shows a partial cut perspective view of the retracting hairholder device disclosed in FIGS. 1 and 2, illustrating details of the internal tensioning members and the retracting cord member.

Referring to FIG. 1, a female's head is represented and includes long hair 51. Retracting hairholder device main body casing 10 is shown in use upon hair 51 wherein retractable cord member 16 engages and binds hair 51 to engender ponytail 61. Referring to FIGS. 2 and 3, retracting hairholder device main body casing 10 is defined by first interlocking component 12 and second interlocking component 14. First interlocking component 12 and second interlocking component 14 shown here as rounded interengaging pieces which are bound together by binding members 31 shown here as a pair of screws. It should be noted that the binding member screws as shown in FIGS. 2 and 3 are shown for illustrative purposes only and any suitable binding means may be employed, including, but not being limited to, snaps, force fitted interlocking components and threading. In addition, the main body casing may be a single unistructurally molded piece or may be defined by a plurality of pieces. Thus, it is to be understood that the disclosed two piece configuration shown in FIGS. 1 and 2 are provided for illustrative purposes only and should not limit the scope of the present invention. Referring to FIGS. 2 and 3 in detail, retractable cord member 16 is attached to first interlocking component 12 at cord member connection point 24 which is located directly below an orifice 20 defined in interlocking component upper surface 18. Connection point 24 may be defined by any suitable retaining means, such as a force fitted connection point or a fused connection point. Retractable cord member 16 extends from fastening point 24 through orifice 22 to connect at connecting point 44 with tension member 42 which is connected to rotatable spool wheel 40. As shown in FIG. 3, tension member 42 is a coiled pliant tensioning member which is integrated with spool wheel 40 so as to impart a winding coiling effect upon cord member 16. However, any suitable tension means may be used, such as an elastic band, a teethed gear, a spring member or otherwise.

With reference to FIGS. 1 through 3, a user grasps cord member 16 and pulls outwardly to increase the size of the loop. Thereafter, hair my be inserted into the loop and the user may release cord member 16 which retracts into main body casing 10 to bind the hair in place. Because flexible cord member 16 is non-elastic, the integrity of the hair is maintained and is protected against breakage as is often caused by conventional elastic components which catch hair and tangle and sever the same.

Figure 4:
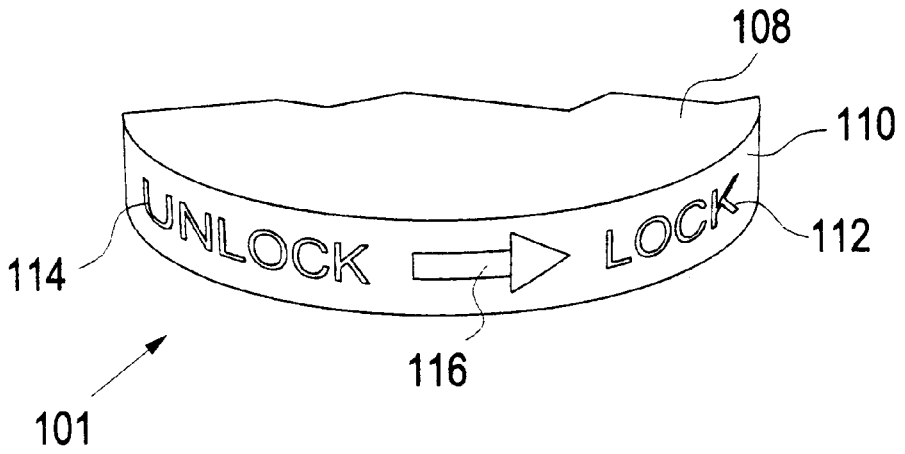
FIG. 4 shows a partial perspective view of an alternative embodiment retracting hairholding device, illustrating details of a locking member.

Referring to FIG. 4, retracting hairholder device main body casing 101 is shown as a single unistructurally molded piece having a single sidewall 110, and having a dual-position slidable locking component 116 which, as disclosed for illustrative purposes only, permits a user to lock the retractable cord member into any desired position including any variety of positions once placed into a locking position. As shown in FIG. 4, indicia 112 and 114 are provided on sidewall 110 wherein the words "LOCK" and "UNLOCK" are represented. Accordingly, a user may slide locking component 116 toward a locked position and lock the cord member in any wound or unwound position.

With reference to FIGS. 1 through 4, a combined locking gear and tension retracting component may be employed, where such a component functions to permit free tensioned rotation in one direction but prevents reverse rotation until a user triggers a release member or provides a sufficient tug upon the cord member to permit rotation, or retraction, in the other direction.

Figure 5:
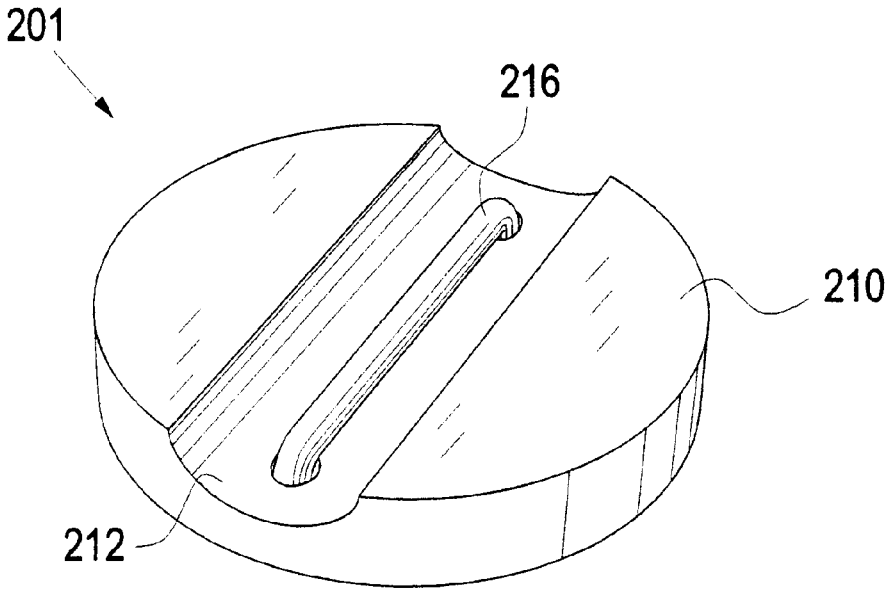
FIG. 5 shows a perspective view of another alternative embodiment retracting hairholding device, illustrating details of a user friendly recessed section.

Referring to FIG. 5, retracting hairholder device main body casing 201 is a single piece which includes upper surface 210 and further includes depressed recess section 212 which serves as an elongated depression area to enable a user to more easily grasp cord member 216 when situated in a fully wound position as shown.

Figure 6:
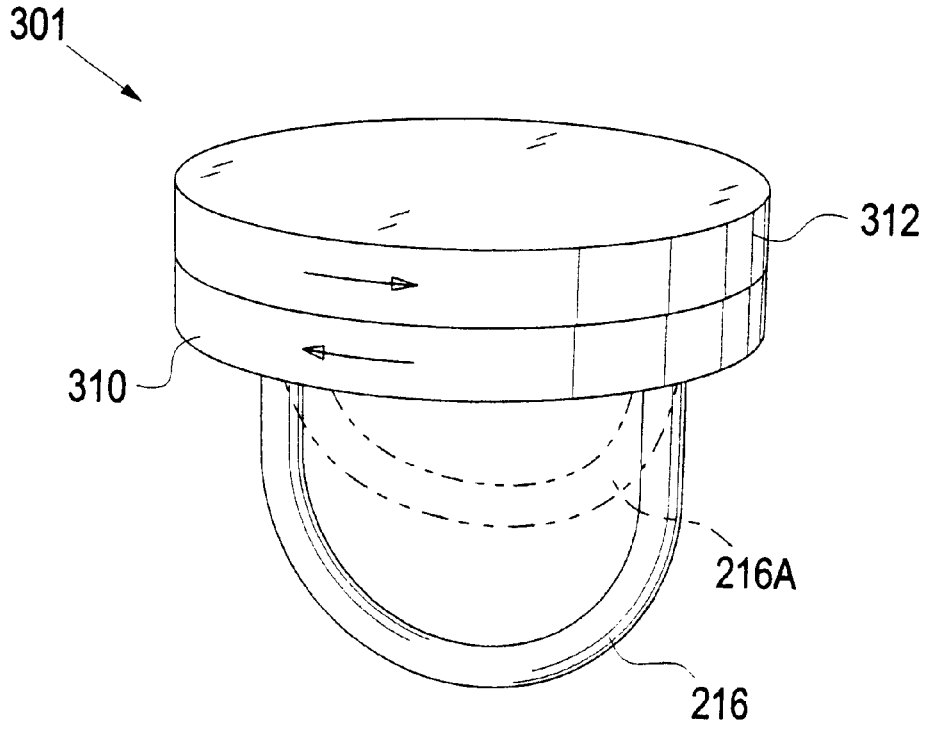
FIG. 6 shows a perspective view of another alternative embodiment retracting hairholding device, illustrating details of a main body casing having torquing capabilities.

Referring to FIG. 6, retracting hairholder device main body casing 301 as shown is defined by first interlocking rotating torque component 310 and second interlocking rotating torque component 312 which rotate relative to one another in order to provide a torquing effect upon retracting retractable cord member 216. As demonstrated by the dotted lines, retractable cord member 216 is shown in an non-torqued position and in a second torqued position 216*a*. In other words, a user rotates components 310 and 312 relative to one another in order to provide sufficient torque upon retractable cord member 216 in order to provide an exceptionally tight binding profile for a lock of hair. Torquing mechanisms are well known in the art and the specific internal components of the torquing mechanism may vary widely without exceeding the scope of the present invention. Hence, whether the manner by which torque is applied is by two pieces rotating relative to one another or, in the alternative, by turning a gear should not be understood to limit the scope of the present invention.

Figure 7:
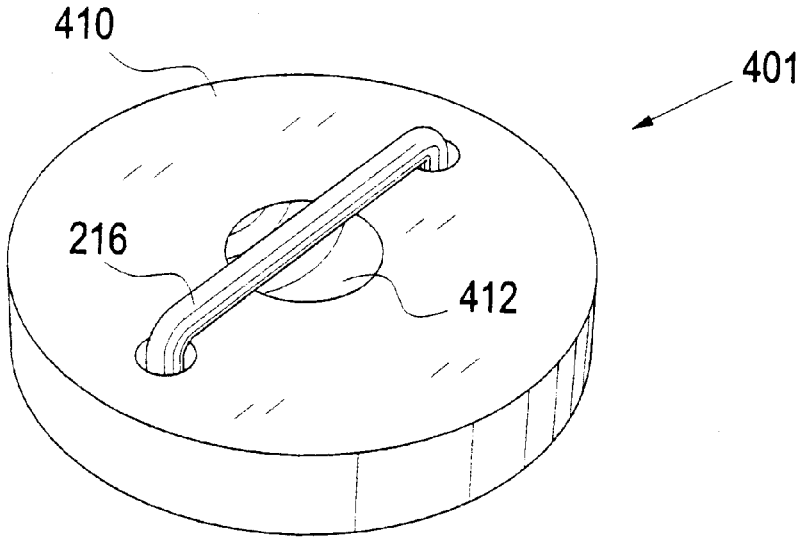
FIG. 7 shows a perspective view of another alternative embodiment retracting hairholding device, illustrating details of a user friendly centrally located annular recessed section.

Referring to FIG. 7, retracting hairholder device main body casing 401 is a single piece which includes upper surface 410 and further includes annular recess section 412 which serves as circular centrally located depression area configured to enable a user to more easily grasp cord member 216 when situated in a fully wound position as shown.

Obviously, numerous modifications and variations of the present invention are possible in light of the above teachings. It is therefore understood that within the scope of the appended claims, the invention may be practiced otherwise than as specifically described herein.

What is claimed is:

1. A retracting hairholder device comprising:

(a) a main body casing, said main body casing having a first side including an upper outer surface and a second side including a lower outer surface, said second side being located opposite said first side, said main body casing having at least one side wall juxtaposed between said first and second sides;

(b) a flexible non-elastic cord member, said cord member having a pre-determined length and a first distal end and a second distal end, said second distal end of said cord member being fixedly attached to a fastening point located upon said upper outer surface, said flexible non-elastic cord member having a first wound position and a plurality of unwound positions;

(c) at least one bore defined within said upper outer surface, said bore receiving said flexible non-elastic cord member therein and permitting movement of said cord member therethrough, such that a portion of said cord member length extends from said fastening point through said bore;

(d) tension winding means for biasing said flexible non-elastic cord member toward said first wound position, wherein said flexible non-elastic cord member first distal end is connected to said tension winding means and is retractably retained within said main body casing, said tension winding means imparting sufficient tension to said flexible non-elastic cord member such that said flexible non-elastic cord member is predisposed toward said first wound position, and wherein when said flexible non-elastic cord member is in said first wound position said cord member is retracted within said main body casing through said bore and is wound about said tension winding means and wherein said portion of said length of said cord member extending from said fastening point to said bore is drawn flush against said upper outer surface of said main body casing, and wherein when said flexible non-elastic cord member is in any of at least one of said unwound positions said cord member is uncoiled from within said main body casing through said bore and from about said tension winding means and wherein said portion of said length of said cord member extending from said fastening point to said bore is drawn away from said upper outer surface of said main body casing to establish a loop.

2. The retracting hairholder device according to claim 1 wherein said tension winding means is defined by a winding reel member and a coiled tension member, said winding reel member being rotatable and pivotal about a central axis and being pivotally and fixedly retained within said main body casing.

3. The retracting hairholder device according to claim 1 wherein said tension winding means is defined by an elastic band member.

4. The retracting hairholder device according to claim 1 wherein said tension winding means is defined by a spring member.

5. The retracting hairholder device according to claim 1 wherein said main body casing is round.

6. The retracting hairholder device according to claim 1 wherein said main body casing is a single unistructurally molded piece.

7. The retracting hairholder device according to claim 1 wherein said main body casing is defined by a first and second piece, said first piece defining said first side and said second piece defining said second side.

8. The retracting hairholder device according to claim 7 wherein said main body casing includes means for fastening said first and second sides together.

9. The retracting hairholder device according to claim 7 wherein said main body casing includes torquing means for imparting additional tension to said flexible non-elastic cord member, said torquing means being cooperative with said tension winding means.

10. The retracting hairholder device according to claim 1 wherein said retracting hairholder device includes locking means for locking said flexible non-elastic cord member in any of said plurality of unwound positions or said first wound position.

11. The retracting hairholder device according to claim 10 wherein said retracting hairholder device locking means is defined by a movable locking member having a first unlocked position and a second locked position.

12. The retracting hairholder device according to claim 11 wherein said retracting hairholder device main body casing includes indicia for indicating said first locked position and said second unlocked position.

13. The retracting hairholder device according to claim 1 wherein said retracting hairholder device main body casing first side upper outer surface includes an elongated recessed section.

14. A retracting hairholder device comprising:

(a) a main body casing, said main body casing having a first side including an upper outer surface and a second side including a lower outer surface, said second side being located opposite said first side, said main body casing having at least one side wall juxtaposed between said first and second sides;

(b) a flexible elastic cord member, said cord member having a pre-determined length and a first distal end and a second distal end, said second distal end of said cord member being fixedly attached to a fastening point located upon said upper outer surface, said flexible elastic cord member having a first wound position and a plurality of unwound positions;

(c) at least one bore defined within said upper outer surface, said bore receiving said flexible elastic cord member therein and permitting movement of said cord member therethrough, such that a portion of said cord member length extends from said fastening point through said bore;

(d) tension winding means for biasing said flexible elastic cord member toward said first wound position, wherein said flexible elastic cord member first distal end is connected to said tension winding means and is retractably retained within said main body casing, said tension winding means imparting sufficient tension to said flexible elastic cord member such that said flexible elastic cord member is pre-disposed toward said first wound position, and wherein when said flexible elastic cord member is in said first wound position said cord member is retracted within said main body casing through said bore and is wound about said tension winding means and wherein said portion of said length of said cord member extending from said fastening point to said bore is drawn flush against said upper outer surface of said main body casing, and wherein when said flexible elastic cord member is in any of at least one of said unwound positions said cord member is uncoiled from within said main body casing through said bore and from about said tension winding means and wherein said portion of said length of said cord member extending from said fastening point to said bore is drawn away from said upper outer surface of said main body casing to establish a loop.

15. The retracting hairholder device according to claim 14 wherein said tension winding means is defined by a winding reel member and a coiled tension member, said winding reel member being rotatable and pivotal about a central axis and being pivotally and fixedly retained within said main body casing.

16. The retracting hairholder device according to claim 14 wherein said main body casing includes torquing means for imparting additional tension to said flexible elastic cord member, said torquing means being cooperative with said tension winding means.

17. The retracting hairholder device according to claim 14 wherein said retracting hairholder device includes locking means for locking said flexible elastic cord member in any of said plurality of unwound positions or said first wound position.

18. The retracting hairholder device according to claim 17 wherein said retracting hairholder device locking means is defined by a movable locking member having a first unlocked position and a second locked position.

19. The retracting hairholder device according to claim 18 wherein said retracting hairholder device main body casing includes indicia for indicating said first locked position and said second unlocked position.

20. The retracting hairholder device according to claim 14 wherein said retracting hairholder device main body casing first side upper outer surface includes an annular recessed section.

* * * * *